United States Patent [19]

Nienstedt

[11] 4,300,372

[45] Nov. 17, 1981

[54] DOOR LOCKING WITH MOVABLE CODE ELEMENTS

[76] Inventor: Richard Nienstedt, Wiesenstr. 10, 2808 Syke, Fed. Rep. of Germany

[21] Appl. No.: 61,185

[22] Filed: Jul. 27, 1979

Related U.S. Application Data

[62] Division of Ser. No. 857,286, Dec. 5, 1977.

[30] Foreign Application Priority Data

Jan. 24, 1977 [DE] Fed. Rep. of Germany ..... 2702759

[51] Int. Cl.[3] ..... E05B 37/02

[52] U.S. Cl. ..... 70/213; 70/288; 70/312

[58] Field of Search ..... 70/219, 213, 220, 289, 70/312, 287, 288

[56] References Cited

U.S. PATENT DOCUMENTS 2,276,733 3/1942 Mejewski ..... 70/219

3,521,471 7/1970 Aretole ..... 70/213

FOREIGN PATENT DOCUMENTS 505205 4/1920 France ..... 70/219

*Primary Examiner*—Robert L. Wolfe

*Attorney, Agent, or Firm*—Charles Hieken

[57] ABSTRACT

A door lock includes a number of code elements for controlling locking and having a clutch including three cams and three cam followers allowing opening when adjusted according to a prescribed code. The cams are balls embedded in a swash plate that wobbles on a bearing ball and are located at the corners of an equilateral triangle. When coded for opening, the three cam followers simultaneously contact the three cams to prevent wobbling and allow the followers to operate as drivers for the swash plate and a lock closing body.

4 Claims, 7 Drawing Figures

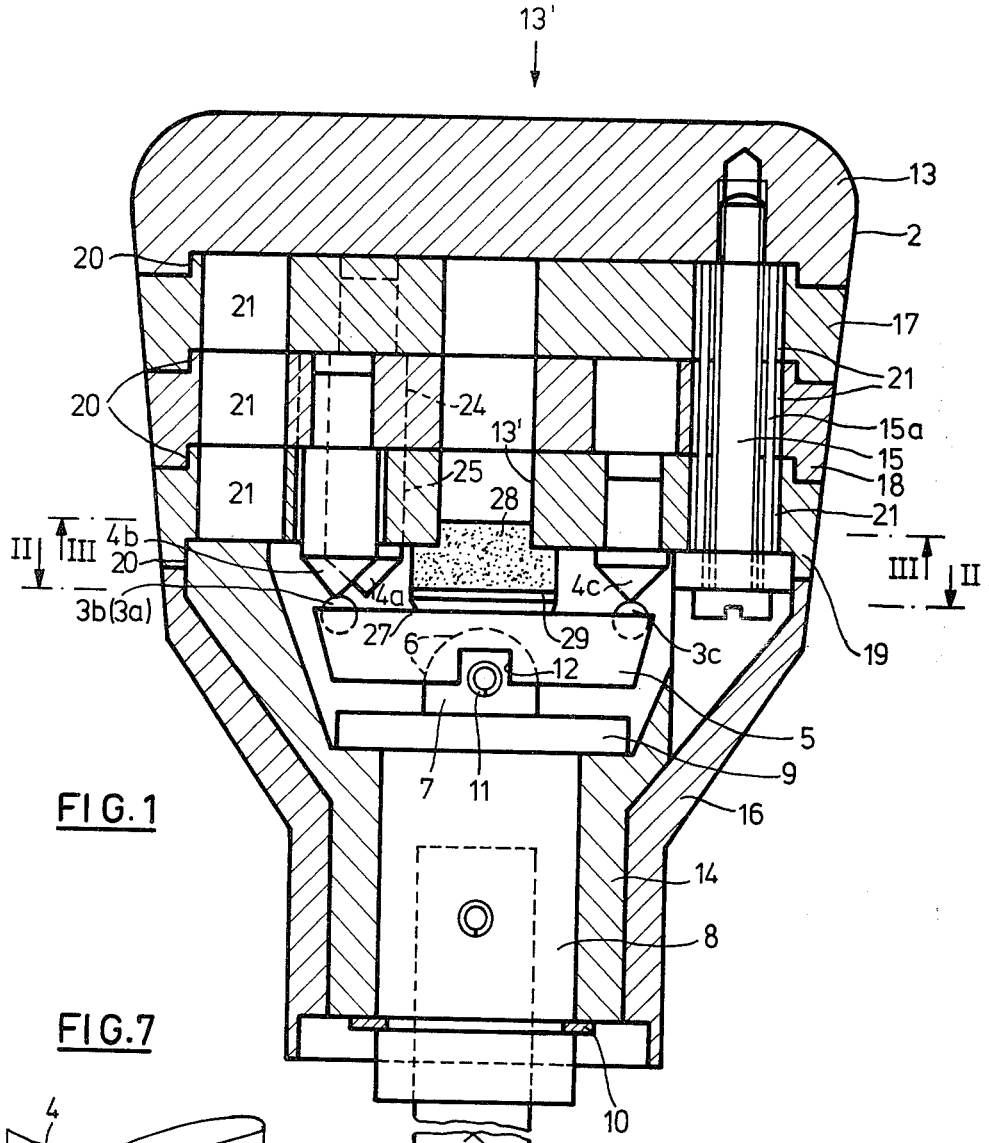
FIG. 1
FIG. 7
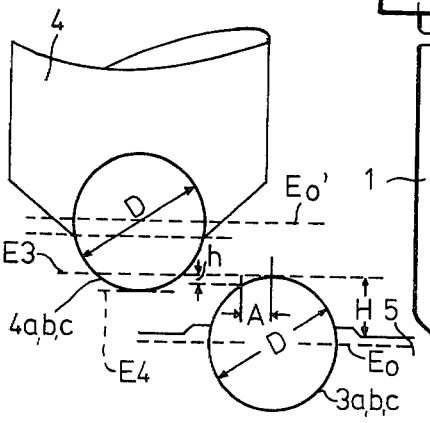
FIG. 4
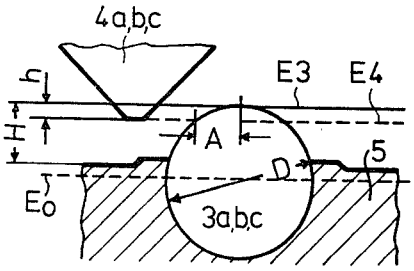

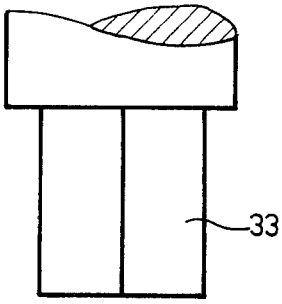
FIG. 5
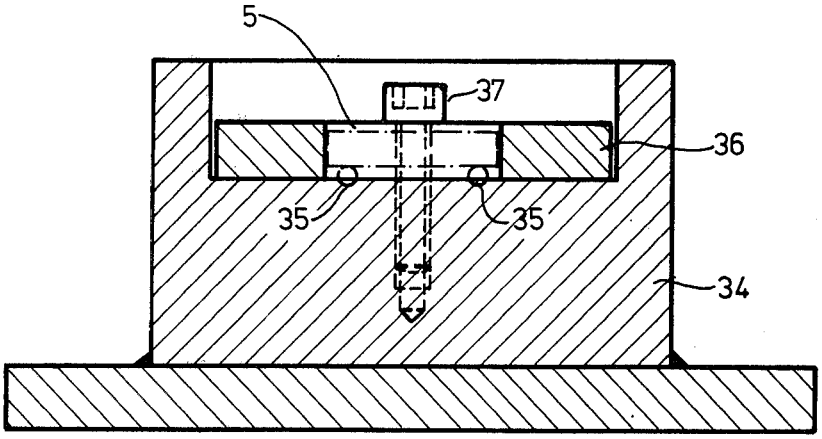
FIG. 6
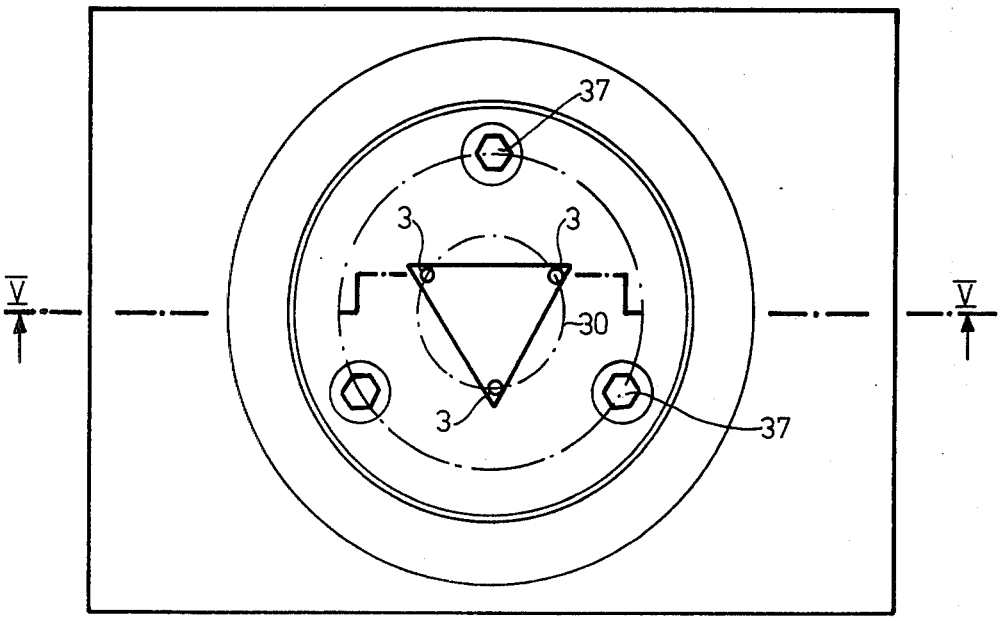

DOOR LOCKING WITH MOVABLE CODE ELEMENTS

This is a division of application Ser. No. 857,286, filed Dec. 5, 1977.

The invention relates to a method and means for producing cams or cam followers, especially for couplings or clutches of door locks which are operated by at least two adjustable code-elements.

The function and utility of door locks which are operated by two or more adjustable code elements such as rotatable letter collars or number collars supporting follower devices engaging a cam device which is non-rotatably connected to a closing body and consists of a swash plate carrying at least two dome-shaped cams is in a high degree dependent on the accuracy to size of said swash plate and the cams at its surface and furthermore is also dependent on the accuracy of the followers engaging said cams.

It is an object of the present invention to provide a new method and means for the production of cams and followers of high accuracy and to achieve this economically.

This problem has been solved with separate cam bodies or follower bodies driven by hammers or presses into the material of a cam carrier or follower carrier, respectively. Thereby, it is possible to use finished goods of high quality and inexpensiveness and it is possible to ensure a very small deviation between cams and followers, respectively.

Preferably, that material of the carrier which is displaced by the cam elements; that is, cams or followers, when they are driven into the carrier may be forced against a conically tapered zone of the cam or follower thereby clutching the cam or follower within the self-made bed.

Preferably, balls are used as cams or followers which are embedded in their carrier beyond their equatorial plane. As is known, balls are available with very precise diameters and high accuracy as well as high hardness, so that cam and followers using such balls guarantee a very small wear or abrasion and a long life.

Figure 3:
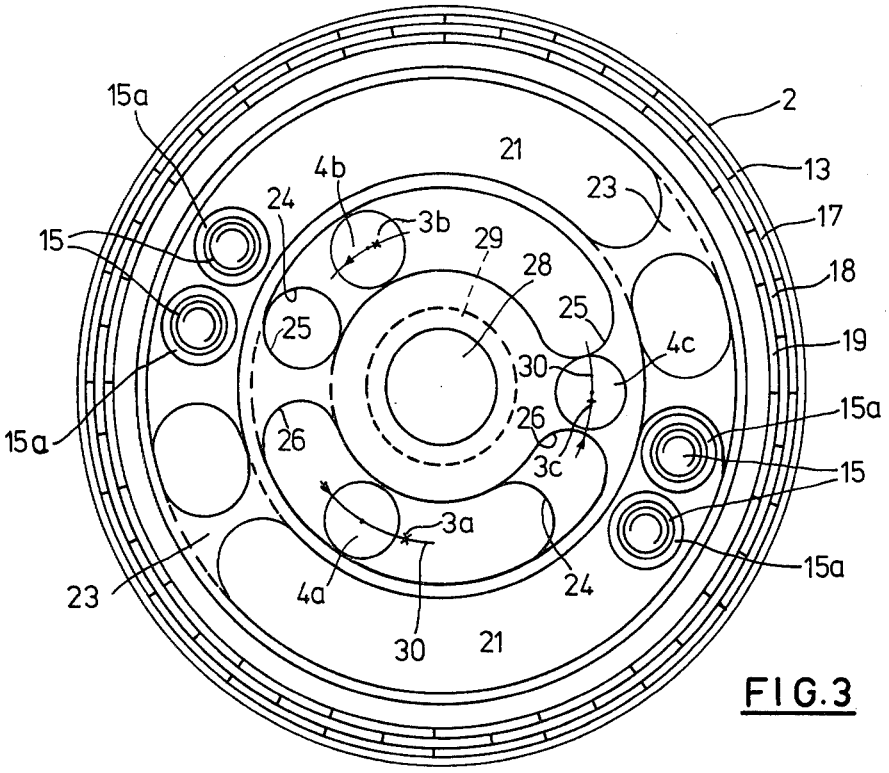
Figure 2:
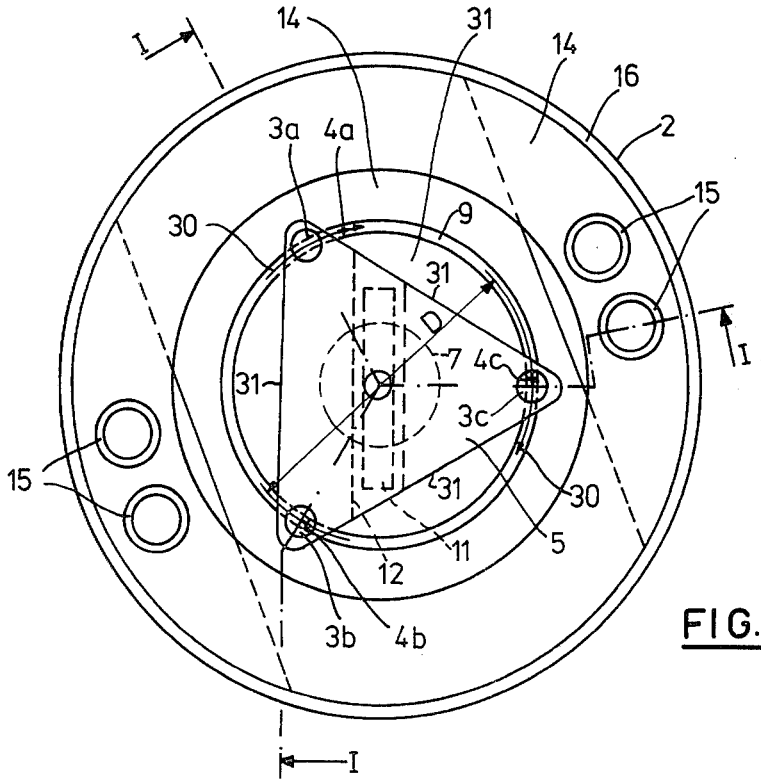

Several embodiments of the invention are shown in the accompanying drawing in which FIG. 1 is a longitudinal section through a door lock with a cam device and a follower device according to the invention along line I—I—I of FIG. 2, FIG. 2 the top view of the lower part of the door lock of FIG. 1 shown in direction II, FIG. 3 is a view from below of the upper part of FIG. 1, shown in direction III, FIG. 4 is a large view of a ball-shaped cam and a conical follower, FIG. 5 is an axial section along line V—V of FIG. 6 through a device for the production of a cam device according to FIGS. 1, 2 and 3, FIG. 6 is a top view of the lower die of the device of FIG. 5 and FIG. 7 is an enlarged view of a ballshaped cam and a ballshaped follower.

The door lock shown in FIG. 1 broadly consists of a closing body 1, preferably in the form of a square pin and a door button 2, which is connectable with said closing body by a coupling or clutch 3,4 including cams 3*a,b,c* and followers 4*a,b,c* when adjusted accurately according to a prescribed code by help of a selector which is described more in detail hereinafter.

The cams 3*a,b,c* are part of a cam disk, or rather are supported by a cam disk 5. This cam disk consists of a swash plate which by a pan 6 is wobbling on a bearing ball 7 arranged at the axle and of closing body 1. The axle end 8 is rotatable relatively to a shell 14 rigidly connected to the door button 2 and is secured against axle displacements by a collar 9 and a spring ring 10.

The cam disk or swash plate 5 is secured against rotation relatively to the axle end 8 by a transverse pin 11, which is arranged within the bearing ball 7 and the ends of which are lying within a notch 12 at the backside of disk 5. There is a slackness between transverse pin 11 and notch 12 wide enough to ensure a non-rotatable connection and to allow a free wobbling of cam disk 5 at top ball 7.

The shell 14 is made of steel in order to obtain a burglarproof arrangement and is connected to the cap 13 of button 2 by four screws 15. The upper conical end of shell 14 encloses the clutch 3,4 and the shell itself is enclosed in a steel jacket 16 with conical upper and cylindrical lower part. Cap 13 and shell 14 are accurately separated by spacers 15*a* surrounding the screws 15. Three collars 17,18,19 are arranged between cap 13 and shell 14 and form a code selector. Each of said rotative collars is supporting one of said followers 4*a,b,c*. Said collars are provided with necks 20 for reciprocal centering and bearing within button 13 and shell 14.

The collars 17,18,19 are provided with concentric slots 21 receiving said screws 15 and spacers 15*a* and connected by bridges (FIG. 3) to the pins 4 or carriers of followers 4*a,b,c*. Said pins are firmly connected each to one of said collars 17,18,19, namely the carrier of follower 4*a* with the upper collar 17 (compare FIG. 1), the carrier of follower 4*b* to the middle collar 18 and the carrier of follower 4*c* to the lower collar 19. The followers 4*a,b,c* in FIGS. 1 and 4 consist of truncated cones at the lower ends of pins 4. The ends of said cones are lying accurately within a common running plane $E_4$. The spacers 15*a* are dimensioned to allow an adjustment of collars 17,18,19 without effort but with a small friction in order to avoid an undesired misplacement when selecting the code for opening the door lock. A central bore hole may be arranged within the upper part of button 2 for better enabling the production of collars 17,18,19. The middle collar 18 is provided with a slot 24 extending over about 180° in order to provide a range of adjustment of pin 4 or follower 4*a* whereas collar 19 is provided with two slots 25 and 26 (FIG. 3) for enabling adjustment of pins 4 of followers 4*a* and 4*b*, respectively.

Cam disk 5 at its frontside or upper side (FIG. 1) is supported by a spring device 29 capable of making wobbling movements and arranged in such a manner that it generally holds the disk 5 accurately in a radial position. In FIG. 1 this spring device consists of a metal collar which fixably is connected to a filler 28 of elastic material which filler is held within a central boring 13' of collar 19. In said radial position all cams 3*a,b,c* lie accurately within a radial plane of culmination $E_3$ (compare FIGS. 4 and 7), which has a distance h from the running plane $E_4$. As may be seen from FIGS. 4 and 7 the distance of running plane $E_4$ from cam disk 5 is smaller than the height H of culmination-plane $E_3$ from disk 5 for the amount h. The followers are running along a common circular way 30 and the cams 3*a,b,c* are arranged at a circle of the same diameter as the way 30. The cams 3*a,b,c* are arranged with an angular distance of accurately 120°, so that their culmination-points define an equilateral triangle. In order to make clear the function of the system the position of followers *4a,b,c*, in FIG. 2 is marked by cross points and in a similar manner in FIG. 3 the position of the culmination points of cams *3a,b,c* by corresponding cross marks.

Owing to the distance between the running plane $E_4$ and the culmination plane $E_3$ the followers during their circular movement will contact in a distance A from the culmination points of the cams and will displace the cams so that the disk 5 will make a wobbling movement. However, such a wobbling movement of disk 5 is not possible only when all three followers *4a,b,c* will simultaneously contact the three cams *3a,b,c*. This is the case if the three collars 17,18,19 are adjusted to the secret code by help of dial scales at the outside of collars 17,18,19. Only in the latter case the disk 5 will make no wobbling movement and the followers *4a,b,c* will operate as drivers for the disk 5 and the connected closing body 1.

Disk 5 is provided with recesses 31 (FIG. 2) between cams *3a,b,c* in order to avoid noises by contact of the followers to the plane upper surface of disk 5.

Cams *3a,b,c* consist of separate balls driven by hammers or presses into the material of disk 5 in such a manner that the balls are embedded in the material of disk 5 beyond their equatorial plane $E_0$. As may be seen from FIG. 7 also the followers *4a,b,c* may consist of balls which are embedded in the tapered ends of pins 4. That material of the carrier 4 or 5 which is displaced by the cams or followers when driven into the carrier is forced against the conically tapered circular zone beyond the equatorial plane $E_0$ and $E_0'$, of the cams and followers, respectively, thereby clutching the cams and followers within their selfmade beds.

A press for driving in the balls into disk 5 is shown in FIGS. 5 and 6 and is provided with a stamp 33 and anvil 34. The anvil 34 is provided with hollows 35 for the receipt and centering of cams *3a,b,c*. These hollows may be made by marking them with help of a center and by following widening by balls 3. Consequently, such hollows may be hardened in the usual manner. A disk 5 is put onto balls 3 inserted in the hollows 35 and is centered by a frame 36 which is connected to the anvil 34 by screws 37. Consequently, the balls 3 are driven by stamp 33 via disk 5 into the disk. By this mode of operation cams *3a,b,c* will have accurately equal heights above disk 5 thus defining a plane culmination surface $E_3$.

The utilization of balls has not merely the advantage that inexpansive cams of high quality are available, besides this advantage the spherical form is preferred because in such a case the distance A of the contact points between cams and followers after exact adjustment of code set collars 17,18,19 is dependent only on the difference h.

Although the present invention has been sufficiently described in the foregoing specification and examples included therein, it is readily apparent that various changes and modifications may be made by those skilled in the art without departing from the spirit and scope thereof. Especially, cams and followers could consist of separated bodies of other form especially could consist of cones although balls are preferred on account of their simple form and inexpensive availability. The invention may also be used for cams and followers other than for door locks.

LIST OF REFERENCES

| | |
|---|---|
| 1 | closing body |
| 2 | door handle, door button |
| 3,4 | coupling, clutch |
| $3_{a,b,c}$ | cams |
| 4 | pins, carriers of 4a,b,c |
| $4_{a,b,c}$ | followers |
| 5 | cam disk, swash plate |
| 6 | pan |
| 7 | top ball, bearing ball |
| 8 | pin, axle end of 1 |
| 9 | collar of 8 |
| 10 | spring ring |
| 11 | transversal pin at 7 |
| 12 | notch in 5 |
| 13 | cap of 2 |
| 13' | bore in 13,17,18,19 |
| 14 | shell, rotatable on 8 |
| 15 | screws |
| 15a | spacers |
| 16 | jacket of 14 |
| 17 | outer set collar |
| 18 | middle set collar |
| 19 | inner set collar |
| 20 | necks of 13,17,18,19 for reciprocal centering and bearing |
| 21 | slot for 15,15 |
| 23,23 | bridges in 21 |
| 24 | slot in 18 for 4a |
| 25 | slot in 19 for 4a |
| 26 | slot in 19 for 4b |
| 28 | stuff |
| 29 | wobbling spring device |
| 30 | circular way of 4a,b,c |
| 31 | recesses |
| 33 | stamp |
| 34 | anvil |
| 35 | cavities |
| 36 | frome |
| 37 | centering bolt |
| D | diameter of cams $3_{a,b,c}$ |
| $E_0$ | equatorial plane of $3_{a,b,c}$ |
| $E_3$ | plane of culmination of $3_{a,b,c}$ |
| $E_4$ | running plane of $4_{a,b,c}$ |
| h | height of cams $3_{a,b,c}$ beyond the running plane $E_4$ of $4_{a,b,c}$ at radical coupling position of cam disk 5 |
| H | height of cams $3_{a,b,c}$ above cam disk 5 |

I claim:

1. In door locking apparatus operated by at least two adjustable movable code elements supporting respective cam follower devices engaging a cam device non-rotatably connected to a closing body and having a swash plate carrying at least two dome-shaped cams the improvement comprising, separate cam elements embedded in the material of a carrier body and protruding above the surface of said carrier body.

2. Door locking apparatus in accordance with claim 1 wherein said carrier body comprises a pin-shaped carrier and said cam element comprises a cam follower embedded in the material at one end of said pin-shaped carrier body and protruding from the end surface thereof.

3. Door locking apparatus in accordance with claim 1 wherein said swash plate at its back side includes a hemispherical pan engaged by a bearing ball and at its front side is supported by a wobbling spring device, whereby alignment of said adjustable code elements to a predetermined unlocking code position with each cam opposite a respective cam follower to prevent wobbling of said swash plate and effect unlocking engagement with said closing body while otherwise positioning said code elements results in at least one cam being outside of alignment with a respective cam follower to allow wobbling and prevent unlocking engagement with said closing body.

4. The improvement in accordance with claim 1 wherein said swash plate comprises said carrier body, said cam elements are ball cam elements, there being at least three of said separate ball cam elements, said ball cam elements being seated in self-made pockets to a depth greater than half the ball diameter in said carrier body clutched by material in said carrier body displaced when said ball cam elements are forced into said carrier body to form said self-made pockets with a dome-shaped portion of said ball cam elements protruding a predetermined distance from the surface of said carrier body with said displaced material constituting the means for keeping said cam elements firmly seated in said self-made pockets.

* * * * *